US005096227A

United States Patent [19]

Pinkerton, Jr.

[11] Patent Number: 5,096,227

[45] Date of Patent: Mar. 17, 1992

[54] RAPID CHANGE DIRECTORY HOLDER

[75] Inventor: Stevens V. Pinkerton, Jr., St. Joseph, Mo.

[73] Assignee: Acoustics Development Corporation, St. Joseph, Mo.

[21] Appl. No.: 573,676

[22] Filed: Aug. 27, 1990

[51] Int. Cl.[5] ..... B42D 17/00

[52] U.S. Cl. ..... 281/48; 281/45; 462/71

[58] Field of Search ..... 281/45, 46, 47, 48, 281/49, 50, 43, 44; 402/7, 24; 462/71, 72; 248/447

[56] References Cited

U.S. PATENT DOCUMENTS

| | | | |
|---|---|---|---|
| 1,132,230 | 3/1915 | Turner | 281/48 |
| 1,654,191 | 12/1927 | Redies et al. | 281/48 X |
| 3,373,749 | 3/1968 | Wance et al. | 281/47 |
| 3,425,421 | 2/1969 | Feder | 281/49 X |
| 3,617,074 | 11/1971 | Rigolini et al. | 281/49 X |
| 4,436,442 | 3/1984 | Miskin | 248/447 X |
| 4,561,623 | 12/1985 | Shepherd et al. | 281/47 X |

FOREIGN PATENT DOCUMENTS

| | | | |
|---|---|---|---|
| 323005 | of 1957 | Switzerland | 281/48 |
| 26052 | of 1911 | United Kingdom | 281/48 |
| 340351 | of 1931 | United Kingdom | 281/48 |

*Primary Examiner*—Joseph M. Gorski
*Assistant Examiner*—Peter Dungba Vo
*Attorney, Agent, or Firm*—Michael Yakimo, Jr.

[57] ABSTRACT

A telephone directory holder and binder spine is designed for use with telephone enclosures. The directory holder comprises a separable directory holder unit which may be inserted in a directory at a site distant from the binder spine which is fixed to the telephone enclosure. The holder unit further comprises cables spanning first and second cable holders. The cable is releasable at one end from a holder to permit individual cable placement within the directory. Engagement of the first and second cable holders with the binder spine secures the holder unit with directory to the binder spine. Pre-placement of the directory holder unit within the directory at an off-site location is thus provided to enhance directory replacement.

4 Claims, 2 Drawing Sheets

RAPID CHANGE DIRECTORY HOLDER

BACKGROUND OF THE INVENTION

The present invention relates to a book holder device. More particularly the invention relates to a telephone directory holder for use in public telephone enclosures and the like which permits the telephone directory to be rapidly and easily changed while affording increased security from inadvertent loss or vandalism.

Telephone directories made available for use in public areas, where little or no supervision over the telephone enclosure or directory can be offered, suffer from extremes of weather, abuse by the customer, and substantial vandalism. In an attempt to protect telephone directories from such harm and extend their useful life, a variety of telephone directory holders have developed which offer protective covering to the telephone directory as well as a means for retaining the directory within the holder to prevent theft and vandalism of the directory.

The means by which the directory is retained in the directory holder presents two competing considerations. On the one hand strength, durability, and resistance to disassembly of the directory securing device are required to withstand the harsh environment. On the other hand, the ability to rapidly and easily disassemble the directory securing device is also required to reduce maintenance. The latter feature is necessary so that in situations where a large number of directories are being utilized the process of updating the directory does not consume an inordinate amount of time. Therefore, these two competing considerations work against one another in the development of directory holding devices which are at once strong and secure and yet present ease and rapidity of directory changeover.

Previous directory holders involve metal rods or rectangular metal strips which are interleaved with pages of the directory to traverse the length of the spine of the telephone directory. The metal rods or strips are then locked into a variety of end pieces which secure the directory within a binder. Typically, however, these metal rods or strips may become misaligned or bent during the course of use or during reinsertion into the directory holder. Once bent from alignment they no longer perform their function satisfactorily. In addition, where the metal rod or strip is simply bent or bowed for insertion into the directory holder, unauthorized removal of the telephone directory is possible as there is no protective means to prevent the disengagement of the rods or strips by other parties.

As alluded to above, an additional problem arises when substantial security is incorporated into a directory holder design. Generally, the greater the security offered by the directory holder the more difficult is the removal of the directory in the field and the more complicated the changeover to a substitute directory volume. Where multiple rods or metal strips are utilized to hold the directory in place, it is especially difficult to align the rods with the pages of the directory while working in the field. Such designs can add substantially to the time and cost of changing over to new directories. In addition, these designs utilize a securing feature, a rod or a metal strip which is intergal with the binder portion of the directory holder. Thus the entire changeover process must be accomplished in the field rather than permitting a portion of the work to be completed at a more convenient site.

SUMMARY OF THE INVENTION

Therefore, it is a principal object of this invention to provide a directory holder which securely fastens a telephone directory into a directory binder.

It is another object of the present invention to provide a directory holder which avoids the previous problems associated with metal rods or strips which bend out of shape and which permit the directory to fall out of the holder.

It is yet another object of the present invention to provide a directory holder which is resistant to tampering by unauthorized individuals.

Yet another object of the present invention is to provide a directory holder which permits the telephone directories to be partially preloaded with the securing device to allow rapid and easy directory changeover in the field.

Yet another object of the present invention is to provide a telephone directory holder whereby the securing rods or cables may be individually manipulated and thus not interfere with one another while insertion of the holding device into the book is being conducted.

The above and further objects and novel features of the invention will more fully appear from the following description when read in conjunction with the accompanying drawings.

These and other objects are satisfied by the invention which provides a book holding spine having a first spine end and a second spine end the spine being mounted within a book binder or protective casing for a book. The spine is adapted to receive a directory holder unit which may be preloaded into a directory or book at some distant site from the location of the spine within the book binder. The directory holder has cables suspended between first and second cable holder devices one of which is removable. The removable cable holder releasably engages the cables to facilitate insertion of the directory holder unit into the directory. The binder spine unit is provided with means at one end of the binder spine for engaging the releasable cable holder. The second end of the binder spine is equipped with means for engaging and fastening the directory holder unit to the binder spine so as to avoid unauthorized release of the directory holder unit from the binder spine.

In other words, this invention provides an apparatus which can rapidly and securely fasten a telephone directory to the directory binder which is permanently attached to a telephone enclosure. Furthermore the invention contemplates a directory holder comprising two units. One unit, the binder spine is permanently secured to the telephone enclosure and is adapted to accepting a directory holder unit. This latter unit may be inserted into a telephone directory or book at some distant location to allow rapid directory changeover in the field while providing substantial security from vandalism for the telephone directory.

DESCRIPTION OF THE PREFERRED EMBODIMENT

Figure 1:
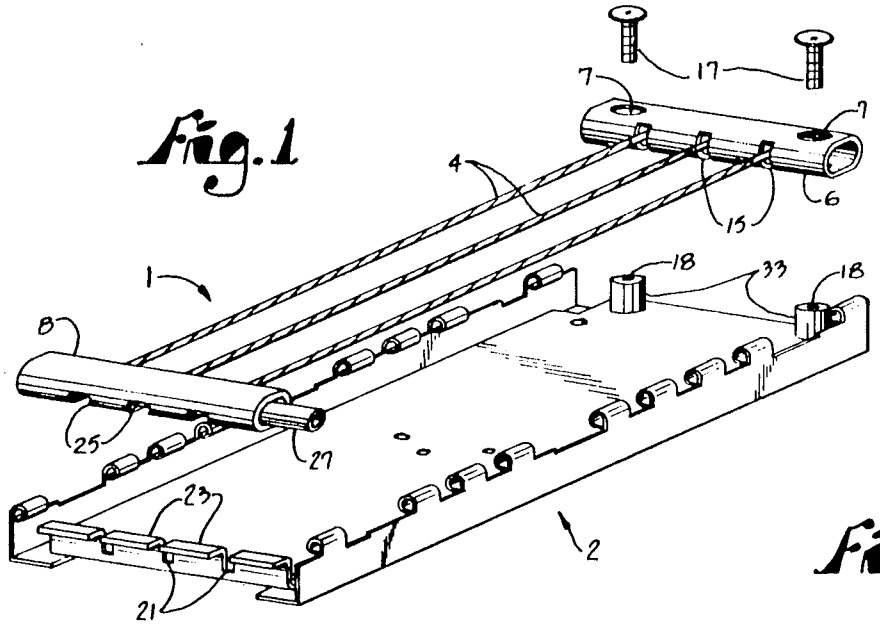
FIG. 1 is a partially exploded view of the preferred embodiment of the invention showing the cables attached to the cable holders which are separated from the binder spine.

Reference is made to FIG. 1 showing a partially exploded view of the components of the preferred embodiment. The directory holder unit 1 is shown positioned above the directory binder spine unit 2. The directory holder unit 1 is composed of a series of cables 4 which are respectively attached at their ends to fixed cable holder 6 and releasable cable holder 8.

Figure 2:
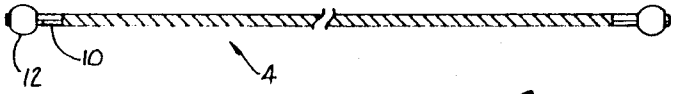
FIG. 2 is a view of one of the cables which is inserted into the cable holders and foreshortened for purposes of illustration.

Referring now to FIG. 2 a representative cable 4 is illustrated. Each end of a cable 4 is equipped with a ball fitting 12 and shank fitting 10 to permit the cable to be held within the cable holders 6 and 8. The cables are held within cable holders 6 and 8 by cable holder slots or grooves 15 (FIGS. 7 and 8) which prevent ball 12 (FIG. 2) from passing beyond the confines of the fixed cable holder 6 or the releasable cable holder 8. The cables are free to move within the length of cable holder grooves 15. The shank 10 affixed to each end of cable 4 prevents wear of the cable by the cable holder grooves 15 as well as by flange grooves 21. The shank 10 protects the cable 4 during movement within the cable holders 6 and 8 as well as during use when flange grooves 21 might rub against the cable 4.

Figure 3:
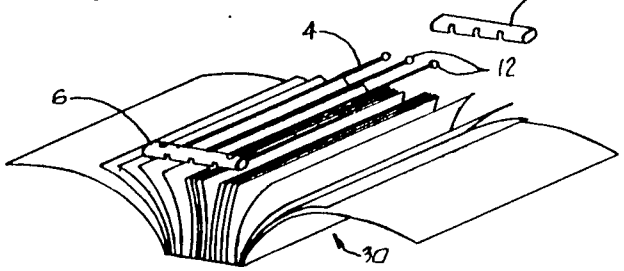
FIG. 3 is a perspective view of the general alignment of the cables prior to placement within a telephone directory and showing the detachment of one of the cable holders to permit insertion of the cables into a directory.
Figure 4:
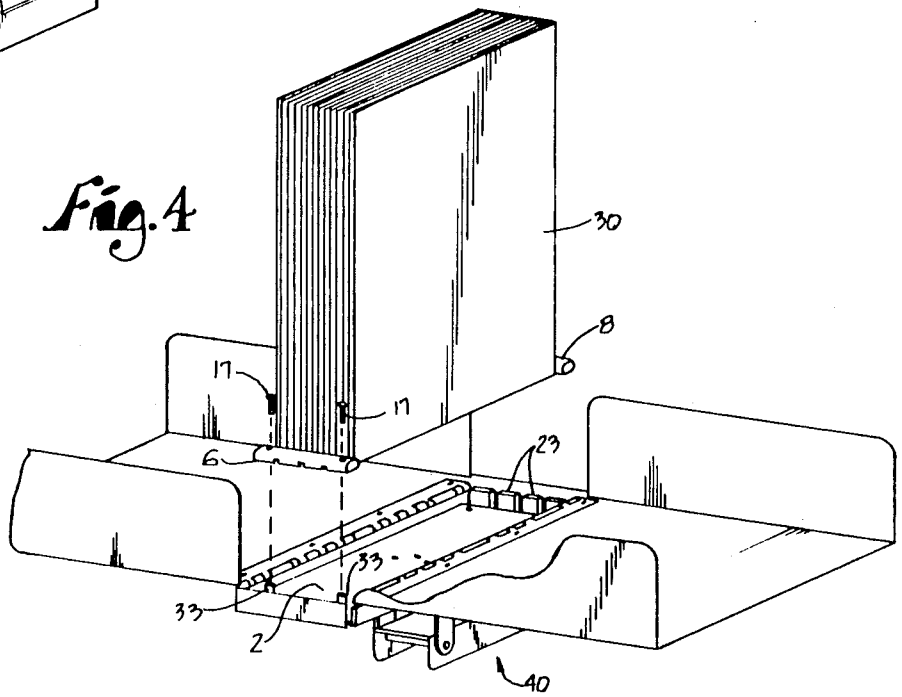
FIG. 4 is a perspective view illustrating the alignment of the telephone directory equipped with the cables and cable holders for insertion into the binder spine.

Referring to FIG. 1 and FIG. 4, it can be seen that the spacing of cables 4 across the width of the cable holders 6 and 8 provides support to the entire book or directory captured therein. It is also evident that the width of the entire directory holder unit 1 may be narrowed or widened to accommodate books of varying width and that the quantity of cables 4 may be increased or decreased to provide sufficient support and security. Referring now to FIG. 3 the placement of the directory holder unit 1 within a book or telephone directory 30 may be observed. In general, each of the cables 4 is placed within a different portion of the book with a section of the pages of the book separating the cables. In this manner, the support of the directory holder unit is distributed across the entire width of the book.

Figure 5:
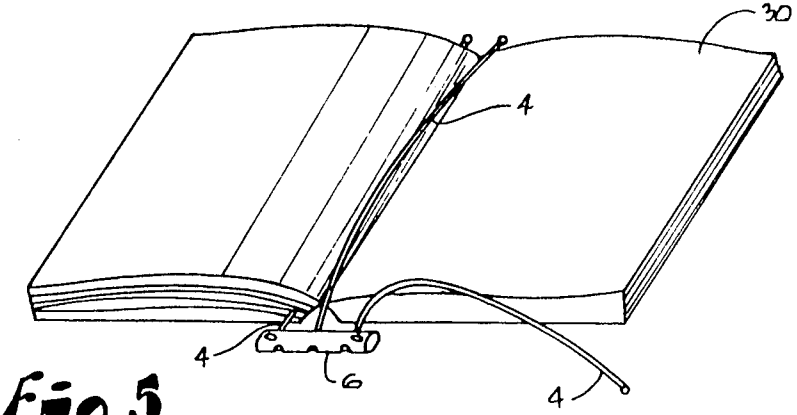
FIG. 5 is a perspective view illustrating the placement of two of the cables between pages of a telephone directory and illustrating the placement of the third cable out of the work area.

Examining FIG. 3 in conjunction with FIG. 5, it is evident that the placement of the directory holder unit 1 is substantially facilitated by the provision of a releasable cable holder 8 on one end of the directory holder unit 1. As shown in FIG. 3 the releasable cable holder 8 has been removed from cables 4. The cables 4 are then freed for individual movement as may be observed in FIG. 5. The individual movement of the cables 4 permits placement of a single cable one at a time within the book or directory. This feature, permitting individual placement of cables, avoids interference from the adjacent cables and substantially eases the cable placement operation.

Upon placement of the cables 4 within the book or directory 30 the cables may be realigned with the voids or groove apertures 25 provided at one end of grooves 15 of releasable cable holder 8. The reattachment of releasable cable holder 8 to cables 4 secures the directory holder unit 1 with the telephone directory or book 30 as shown in FIG. 6.

Figure 7:
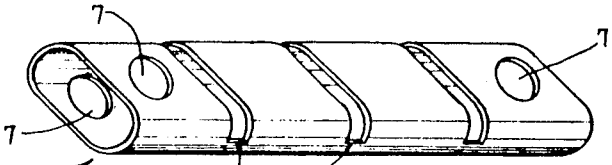
FIG. 7 is a perspective view of the fixed cable holder on an enlarged scale and illustrating the slots which allow movement of cables while held within the fixed cable holder.

Referring now to FIG. 7, showing a detailed view of fixed cable holder 6, cable holder grooves 15 may be seen within which are slidably mounted cables 4. The cables are held within cable holder grooves 15 by ball 10. At the time of manufacture the cables are inserted within fixed cable holder 6. However, should a cable become worn or broken a new cable may be inserted into fixed cable holder 6. This is accomplished by the removal, from one end of the cable, of shank 10 and ball 12 to permit insertion of the cable through the fixed cable holder. The shank 10 and ball 12 may then be reattached once the cable 4 has been mounted within the fixed cable holder. Also shown in FIG. 7 are fixed cable holder apertures 7. These apertures receive fastener posts 33 (FIG. 10) which secure the directory holder unit 1 to the binder spine 2. Cable holder grooves 15 traverse the entire width of fixed cable holder 6 thus allowing for additional freedom of movement of cables 4 while the directory holder unit 1 is being placed within a telephone book or directory as shown in FIG. 5.

Figure 8:
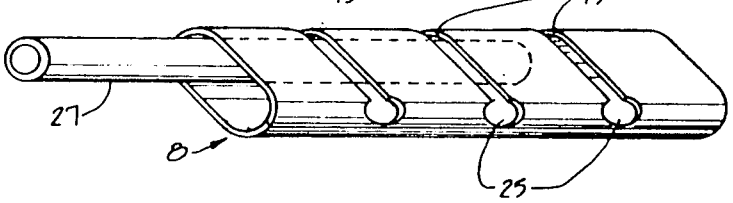
FIG. 8 is a perspective view of the releasable cable holder on an enlarged scale and illustrating the enlarged apertures at one end of each of the slots so cables may be removed therefrom.

Referring now to FIG. 8 wherein is shown a detailed view of the releasable cable holder 8, it may be seen that voids or groove apertures 25 are provided which operate in conjunction with cable holder slots or grooves 15. Groove apertures 25 permit the cable ball 12 to be removed from releasable cable holder 8 thereby permitting the previously discussed individual placement of cables 4 in telephone directory 30 as shown in FIGS. 3 and 5. Upon reinsertion of cables 4 into releasable cable holder 8, the groove apertures 25 are then blocked by keeper pin 27 (FIG. 6) to prevent inadvertent release of cables 4 from the releasable cable holder 8. The action of keeper pin 27 to prevent cables 4 from release from the releasable cable holder 8 is required only when the directory holder unit 1 is not in contact with binder spine unit 2. As may be seen in FIG. 9, when the releasable cable holder 8 is positioned within the binder spine unit 2 the tension on cables 4, which is opposed by flanges 23, prevents ball 12 from exiting groove apertures 25.

Figure 6:
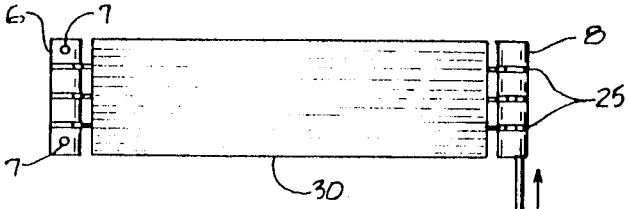
FIG. 6 is a side view of a book spine illustrating the cable holder placed within the book and showing the introduction of the keeper pin into the releasable cable holder.

The present invention allows for the placement of the directory holder unit 1 within a book or telephone directory, as is shown in FIGS. 4 and 6, to be accomplished at any convenient location. The placement of the directory holder unit 1 within the book 30 may occur at a central shop location for later distribution of the new books or directories to a distant location having a telephone binder equipped with binder spine unit 2. At a location such as an airport, the binder casing 40 containing the binder spine 2 is permanently fixed to the telephone enclosure or other point offering a public reference book. Service personnel may then quickly and conveniently remove the old directory or book from the binder casing without taking the time to remove the directory holder unit 1 from the old book. The new directory, already containing a directory holder unit 1, may then rapidly be inserted to the binder spine unit 2 in the fashion yet to be described herein. The old book or telephone directory may then be carried back to the central location or shop for removal of the directory holder unit 1. After removal, the directory holder unit 1 may then be applied to yet another new book or directory for later placement in a binder casing 40 equipped with binder spine unit 2 at yet another distant location.

Operation of The Invention

Figure 10:
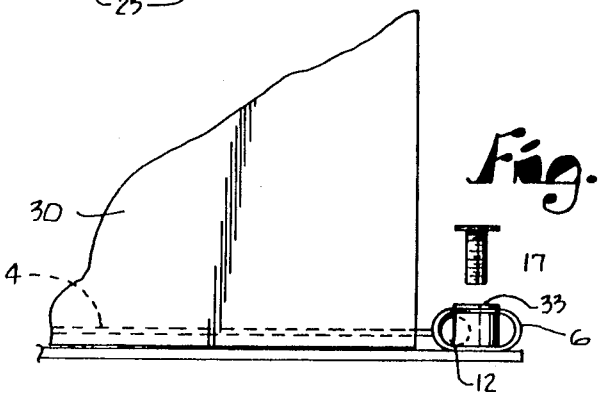
FIG. 10 is a partially exploded side view of the fixed cable holder in place on the binder spine and showing the fastener prior to entry into the fastener receptacle of the binder spine with the cables being shown in phantom lines in position within a directory.
Figure 9:
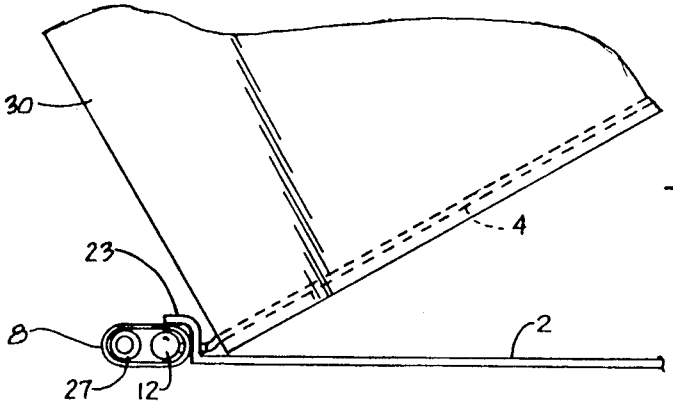
FIG. 9 is a side view illustrating the capture of the releasable cable holder by the flanges of the binder spine and illustrating in phantom lines the placement of the cables within the directory.

Referring now to FIGS. 4, 9 and 10 the placement of the directory holder unit 1 within a telephone directory binder 40 equipped with binder spine unit 2 will be described. Upon arrival at a distant location for directory changeover, the old directory will be found secured by a directory holder unit 1 to binder spine unit 2 within the binder casing 40. The old directory is removed by releasing fasteners 17 on fixed cable holder 6 (FIG. 10). The old directory is then released from the binder spine unit 2 by applying pressure so as to release fixed cable holder 6 from contact with fastener posts 33 which extend through fixed cable holder apertures 7. When fixed cable holder 6 is released from contact with fastener posts 33 directory holder unit 1 may be inclined and released from under flanges 23 (FIG. 9) which are securing releasable cable holder 8. The old directory may then be set aside for later removal of the directory holder unit 1.

Attachment of the new book or directory, already equipped with directory holder unit 1, is accomplished by first sliding releasable cable holder 8 into underlying contact with flanges 23 such that one end of the book is secured within the binder spine 2 of the binder casing 40. The entire directory 30 and directory holder unit 1 may then be lowered into place such that fixed cable holder apertures 7 receive fastener posts 33 of binder spine 2. This brings the directory holder unit 1 into secure contact with binder spine 2. The directory holder unit may then be secured to the binder spine contained within binder casing 40 by fasteners 17 which are received within fastener apertures 18 of fastener posts 33.

Although a now preferred embodiment of this invention has been illustrated and described, it is understood that the scope of the invention is not to be restricted thereto except is set forth in the following claims and allowable functional equivalents thereof.

I claim:

1. An apparatus for removably securing a book within a book binder comprising:

at least one cable having a first cable end and a second cable end, said cable being adapted for longitudinal placement between the pages of the book;

a first cable holder having a void therein and a slot in communication with said void, said slot having a width sufficient for extension of a portion of said first cable end therethrough;

a fastener fixed to said first cable end, said fastener having a configuration allowing passage through said void in said first cable holder while precluding passage through said slot;

means insertable within said first cable holder for maintaining said fastener in said first cable holder at a position adjacent said slot;

a spine having a first spine end and a second spine end, said spine mounted within said book binder;

an upstanding flange at said first spine end with a portion of said flange displaced from said first spine end to overlie said first cable holder upon placement of said first cable holder between said first spine end and said flange portion while allowing for an extension of said at least one cable through said flange;

a second cable holder having said second cable end attached thereto;

at least one aperture through said second cable holder;

at least one post projecting from said second spine end for extension through said aperture in said second cable holder; and means for securing said second cable holder to said post, whereupon said at least one cable traverses said spine with the book restrained between said cable and said spine.

2. The apparatus as recited in claim 1, wherein said means for maintaining said fastener in said first cable holder comprises:

a keeper pin;

an aperture in said first cable holder for insertion of said keeper pin within said holder adjacent said void, said pin restraining movement of said fastener to a position adjacent said void whereupon said pin precludes passage of said fastener through said void.

3. The apparatus as recited in claim 1, wherein said means for securing said second cable holder to said post is a screw.

4. The apparatus as recited in claim 1, wherein said fastener further comprises a ball and shank fitting, said ball having a configuration for said passage through said void while precluding passage through said slot.

* * * * *